US006094755A

United States Patent [19]

Matta

[11] Patent Number: 6,094,755

[45] Date of Patent: Aug. 1, 2000

[54] MAINTAINING A CLOSURE OF A SHOWER CURTAIN

[76] Inventor: Gregory C. Matta, 2990 Robar, Las Vegas, Nev. 89121

[21] Appl. No.: 09/149,065

[22] Filed: Sep. 8, 1998

[51] Int. Cl.[7] ..... A47K 3/22

[52] U.S. Cl. ..... 4/558; 4/608

[58] Field of Search ..... 4/558, 608, 609, 4/610

[56] References Cited

U.S. PATENT DOCUMENTS

D. 284,024 5/1986 Olson .
4,594,741 6/1986 Payne .
4,759,087 7/1988 Zeilinger .
4,825,481 5/1989 Lonberger .

*Primary Examiner*—Robert M. Fetsuga

[57] ABSTRACT

A rectangular base strip and a pliable magnetized strip are of substantially equal dimensions. An end portion of one side of the base strip is connected to an end portion of a side of the magnetized strip. Double-sided tape is used to adhesively connect the other side of the base strip to a wall of a bath facility. Because of a magnetic attraction between the strips, an edge of a shower curtain is self releasably maintained between unconnected portions of the strips. In other words, the edge is released by opening the curtain.

11 Claims, 2 Drawing Sheets

MAINTAINING A CLOSURE OF A SHOWER CURTAIN

BACKGROUND OF THE INVENTION

1. Field of Invention

This invention is in the general field of domestic bath facilities and, more particularly, is a device that maintains an edge of a curtain against movement.

2. Description of the Prior Art

A domestic bath facility typically includes a shower head mounted on a wall above a bathtub. Water from the shower head flows onto a person in the tub who is taking a shower.

The facility usually is within a partial enclosure formed by three walls that are contiguous with three of four sides of the tub, respectively. The person wanting to take a shower steps through an open side of the partial enclosure into the tub.

Splashing of water from the shower head to the exterior of the tub is often prevented by a panel that is mounted atop an edge of the tub proximal to the open side of the partial enclosure. The panel is usually made of either glass or plastic.

Although the panel effectively prevents the splashing of water to the exterior of the tub, it is expensive. Additionally, when the person slips or falls in the tub, the panel can break and cause serious injury.

A shower curtain is an older, safer but less effective device than the panel for preventing the splashing of the water to the exterior of the tub. There is usually a space between a wall of the partial enclosure and an edge of the shower curtain through which the water is splashed. Heretofore, there has not been a simple, inexpensive device for preventing the water from splashing to the exterior of the tub.

SUMMARY OF THE INVENTION

An object of the present invention is to prevent a splashing of water from a shower head on a wall above a bathtub to the exterior of the tub.

Another object of the present invention is to inexpensively prevent a splashing of water from a shower head on a wall above a bathtub to the exterior of the tub.

According to the present invention, a base strip has one surface with an end that is connected to a flexible magnetic strip. The other surface of the base strip is adapted for connection to a wall of a domestic bath facility.

The invention is an inexpensive device that substantially eliminates a space between a wall of a partial enclosure of a bath facility and a shower curtain by maintaining an edge of the shower curtain close to a wall. The edge is released by opening the curtain. Therefore, the edge is maintained in a self releasing manner.

Other objects, features, and advantages of the invention should be apparent from the following description of the preferred embodiment thereof as illustrated in the accompanying drawing.

DESCRIPTION OF THE EMBODIMENTS

Figure 1:
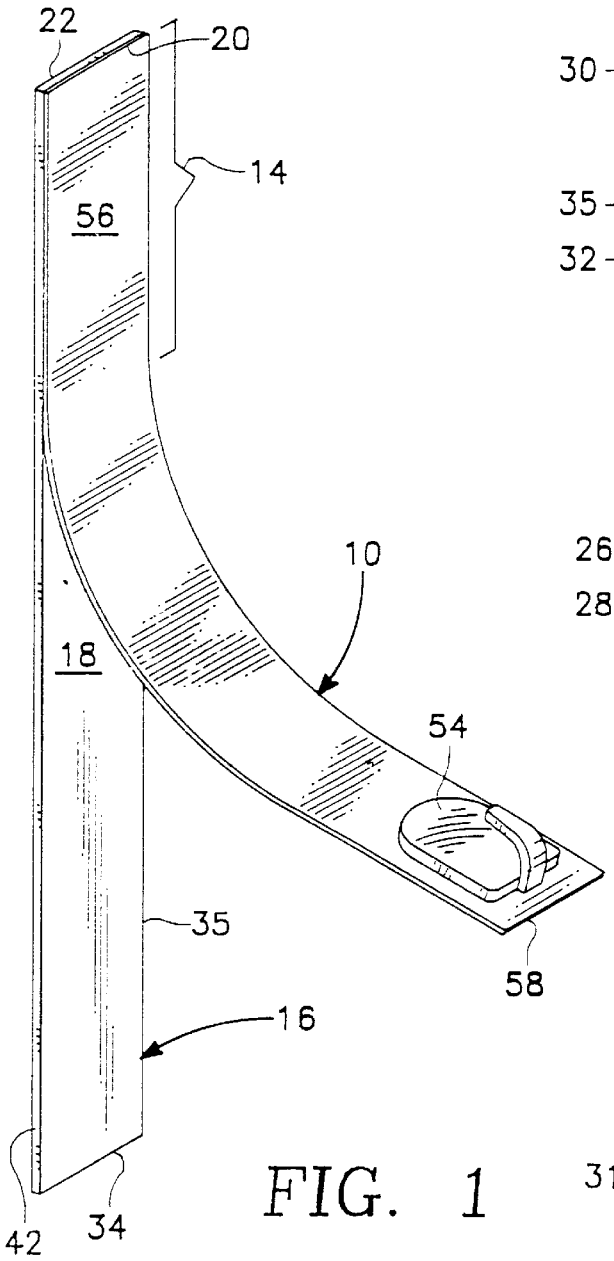
FIG. 1 is a perspective view of a first embodiment of the present invention that provides a showing of a handle that is mounted on a surface of a magnetic strip.
Figure 2:
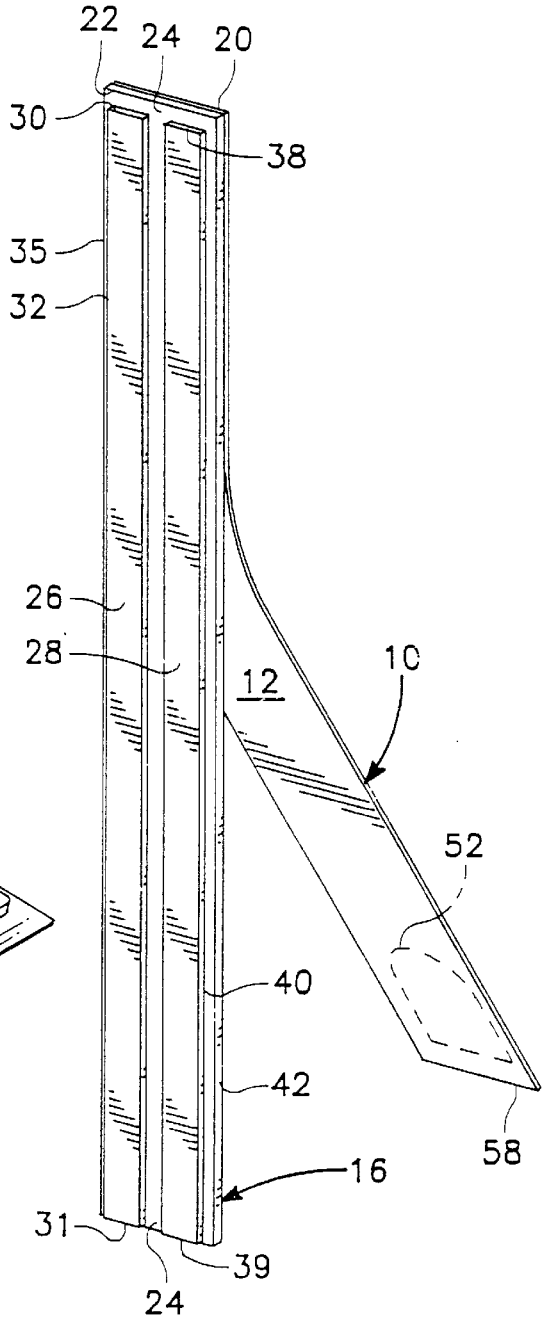
FIG. 2 is a perspective view of the embodiment of FIG. 1 that provides a showing of adhesive strips that are mounted on one side of a base strip.

As shown in FIGS. 1 and 2, in a first embodiment of the present invention, a flexible, rectangular plastic magnetic strip 10, of a type well known in the art, has a surface 12 (FIG. 2) that is adhesively connected to a rectangular base strip 16 that is a ferromagnetic metal. More particularly, the strip 10 has an end portion 14 where the surface 12 is fixedly connected to a surface 18 of the strip 16 at an end portion 19 thereof.

The strips 10, 16 are of substantially equal dimensions with a top edge 20 of the strip 10 in substantial alignment with a top edge 22 of the strip 16. Because the surface 12 is magnetized and the strip 16 is ferromagnetic, there is a force of magnetic attraction between the strips 10, 16. Preferably, the strip 16 is made from galvanized iron that is painted with a decorative, water-resistant, paint.

The strip 16 has a surface 24 (FIG. 2) whereon a pair of double-sided rectangular adhesive strips 26, 28 are adhesively connected. Preferably, the strip 26 has short edges 30, 31 a long edge 32 that are respectively proximal and parallel to the edge 22 and edges 34, 35 (FIG. 1) of the strip 16. Correspondingly, the strip 28 has short edges 38, 39 and a long edge 40 (FIG. 2) that are respectively proximal and parallel to the edges 22, 34 and an edge 42 of the strip 16. The strips 26, 28 have a space therebetween that is of no significance.

Figure 5:
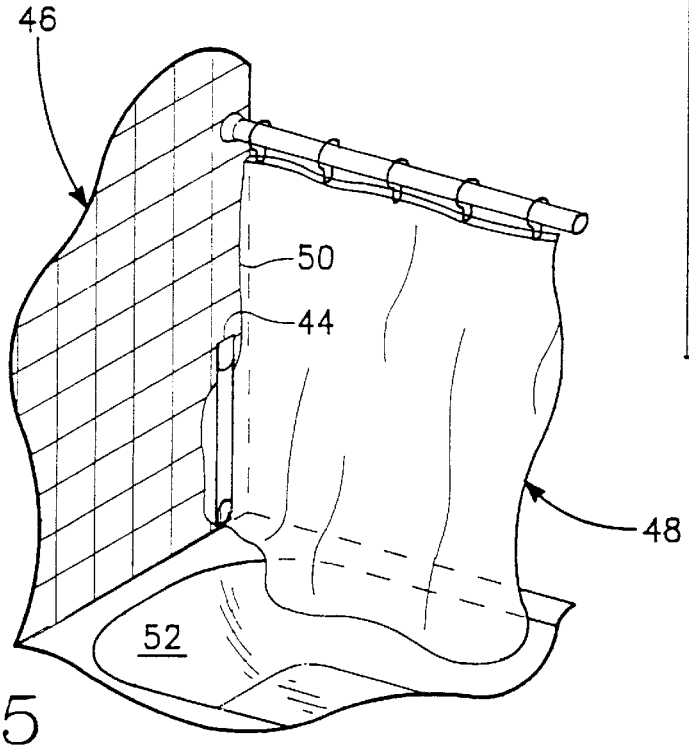
FIG. 5 is a perspective view of a domestic bath facility where an edge of a shower curtain is retained in accordance with the invention.

As shown in FIG. 5, the strips 10, 16, 26, 28 (FIGS. 1 and 2) form an assembly 44 (FIG. 5). The strips 26, 28 adhesively connect the assembly 44 to a wall 46 of a domestic bath facility.

A shower curtain 48 of the bath facility has an edge 50. When a portion of the edge 50 is placed between the strips 10, 16, it is pressed between the strips 10, 16 because of the magnetic attraction therebetween, whereby the shower curtain 48 is closed. Because of the closure, water from a shower head (not shown) does not splash to the exterior of a bathtub 52 of the bath facility.

It should be understood that the portion of the edge 50 is easily pulled from between the strips 10, 16 when the curtain 48 is pulled open. Accordingly, the portion of the edge 50 is maintained between the strips 10, 16 in substantially a self releasing manner.

Preferably, a handle 54 (FIG. 1), having the general shape of a hook, is connected to an outer surface 56 of the strip 10 adjacent to an edge 58 thereof. When non-adhesively connected portions of the strips 10, 16 are in a magnetically maintained contact, they are easily separated by pulling on the handle 54.

Figure 3:
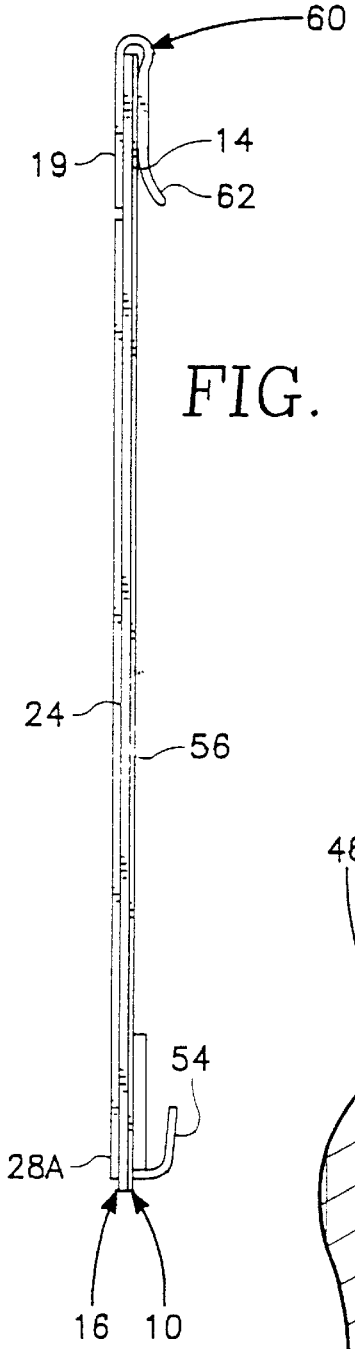
FIG. 3 is a side elevation of a second embodiment of the present invention.
Figure 4:
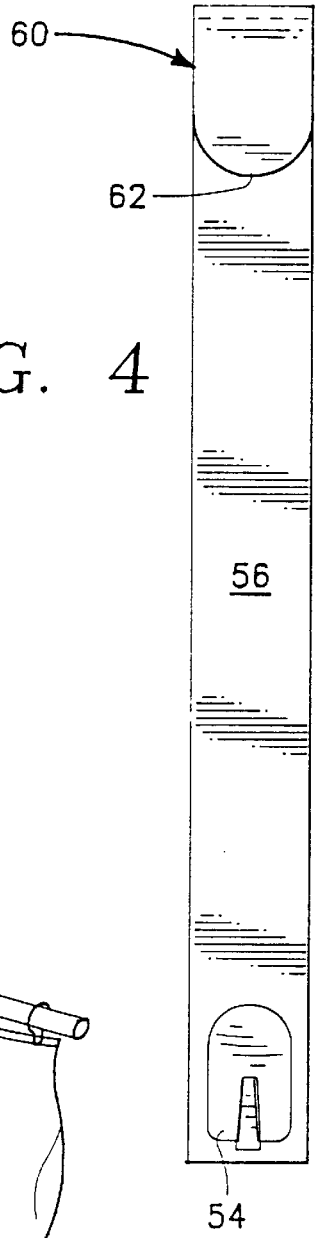
FIG. 4 is a front elevation of the embodiment of FIG. 3.

As shown in FIGS. 3 and 4, a second embodiment of the invention includes the strips 10, 16 of the first embodiment. However, a rectangular double-sided adhesive strip 28A, similar in width to the strip 28 of the first embodiment extends to the top end portion 19. A double-sided adhesive strip (not shown), similar in size to the strip 28A, is disposed parallel to the strip 28A with a spacing therefrom similar to the spacing between the strips 26, 28 of the first embodiment.

A retaining clip 60, similar in shape to a money clip, fits over the top end portions 14, 19. The clip 60, maintains a connection between the top end portions 14, 19. Hence, the adhesive connection between the end portions 14, 19 is optional.

A curved end 62 of the clip 60 extends outward from the surface 56. Because of the clip 60, when unconnected portions of the strips 10, 16 are separated prior to having the portion of the edge 50 (FIG. 5) pressed therebetween, the curved end 62 reduces stress upon the end portion 14.

In an alternative embodiment, the strips 10, 16 are both plastic magnetic strips with the surfaces 12, 18 being of opposite polarity to develop an increased attraction force therebetween.

While the invention has been particularly shown and described with reference to embodiments thereof, it should be understood by those skilled in the art that changes in form and detail may be made therein without departing from the spirit and scope of the invention.

I claim:

1. Apparatus for maintaining a closure of a curtain, comprising:

a base strip;

a flexible magnetic strip that has a magnetized surface and an outer surface, one surface of said base strip having a portion that is connected to a portion of said magnetized surface, a magnetic attraction between unconnected portions of said strips being suitable for pressing an edge of the curtain therebetween; and means for connecting said strips to a wall.

2. The apparatus of claim 1 wherein said strips are of substantially equal dimensions.

3. The apparatus of claim 2 wherein said strips are rectangular with an end portion of said magnetized surface being adhesively attached to an end portion of said base strip.

4. The apparatus of claim 2 wherein said strips are rectangular, additionally comprising a retaining clip, in the general shape of a money clip, that fits over end portions of said strips to maintains a connection therebetween, a curved end of said clip extending outward from said outer surface.

5. The apparatus of claim 4 wherein said end portions of said strips are adhesively connected.

6. The apparatus of claim 1 additionally comprising a handle connected to said outer surface of said magnetized strip.

7. The apparatus of claim 1 wherein said handle has the general shape of a hook.

8. The apparatus of claim 1 wherein said means is a double-sided adhesive strip that is adhesively connected to said base strip.

9. The apparatus of claim 1 wherein said base strip is made from galvanized iron that is painted with a water-resistant paint.

10. The apparatus of claim 1 wherein said base strip is a flexible magnetic plastic wherein said adhesively connected surfaces are of opposite polarities.

11. The apparatus of claim 1 wherein a retaining clip, similar in shape to a money clip.

* * * * *